US008545279B2

(12) United States Patent
Cantemir et al.

(10) Patent No.: US 8,545,279 B2
(45) Date of Patent: Oct. 1, 2013

(54) MARINE PROPULSION SYSTEM

(75) Inventors: Codrin-Gruie Cantemir, Columbus, OH (US); Gildo Pallanca, Monte Carlo (MC)

(73) Assignee: The Ohio State University, Columbus, OH (US)

( * ) Notice: Subject to any disclaimer, the term of this patent is extended or adjusted under 35 U.S.C. 154(b) by 0 days.

(21) Appl. No.: 13/304,185

(22) Filed: Nov. 23, 2011

(65) Prior Publication Data

US 2012/0071045 A1 Mar. 22, 2012

Related U.S. Application Data

(63) Continuation of application No. 12/993,066, filed as application No. PCT/US2009/044366 on May 18, 2009, now abandoned.

(60) Provisional application No. 61/053,817, filed on May 16, 2008.

(51) Int. Cl.

| | |
|---|---|
| ***B63H 11/14*** | (2006.01) |
| ***B63H 11/00*** | (2006.01) |
| ***B63H 11/09*** | (2006.01) |
| ***B63H 11/103*** | (2006.01) |

(52) U.S. Cl.
USPC ..... 440/38; 440/44; 440/45; 440/47; 60/221

(58) Field of Classification Search
USPC ..... 440/38, 44, 45, 47; 60/221, 222
See application file for complete search history.

(56) References Cited

U.S. PATENT DOCUMENTS

| | | | | |
|---|---|---|---|---|
| 1,375,601 | A * | 4/1921 | Morize | 60/264 |
| 2,052,869 | A * | 9/1936 | Coanda | 239/418 |
| 2,351,750 | A * | 6/1944 | Fawkes | 114/20.2 |
| 2,528,354 | A * | 10/1950 | Flanagan | 60/221 |
| 3,273,333 | A * | 9/1966 | Roulund | 60/221 |
| 3,337,121 | A * | 8/1967 | Coanda | 417/167 |
| 3,402,555 | A | 9/1968 | Piper | |
| 3,808,804 | A * | 5/1974 | Scott-Scott | 60/221 |
| 3,889,622 | A * | 6/1975 | Scott-Scott | 440/45 |
| 4,343,611 | A * | 8/1982 | Scott-Scott | 440/45 |
| 4,767,364 | A | 8/1988 | Lenz | |
| 5,344,345 | A * | 9/1994 | Nagata | 440/44 |
| 5,505,639 | A | 4/1996 | Burg | |
| 5,598,700 | A | 2/1997 | Varshay et al. | |
| 6,662,549 | B2 | 12/2003 | Burns | |
| 6,881,110 | B1 | 4/2005 | Abdel-Maksoud et al. | |
| 2003/0013356 | A1 | 1/2003 | Burns | |

FOREIGN PATENT DOCUMENTS

| | | | |
|---|---|---|---|
| FR | 518485 | A | 5/1921 |

* cited by examiner

*Primary Examiner* — Ajay Vasudeva
(74) *Attorney, Agent, or Firm* — Standley Law Group LLP

(57) ABSTRACT

A marine propulsion system comprising, in one embodiment: a fuel-filled tank; an air compressor that generates compressed air; an engine that receives fuel from the tank, wherein the air compressor is powered by the engine; and at least one hot gas generator that receives compressed air from the air compressor, the hot gas generator comprising: (a) a combustion chamber having an inlet and an outlet, the compressed air injected into the combustion chamber at the inlet, the combustion chamber adapted to produce hot gas; (b) an injection nozzle that receives fuel from the tank, the injection nozzle positioned proximate to the inlet of the combustion chamber, the injection nozzle adapted to spray the fuel into the combustion chamber; and (c) an exhaust Coanda nozzle positioned at the outlet of the combustion chamber through which the hot gas produced in the combustion chamber is discharged from the hot gas generator.

8 Claims, 3 Drawing Sheets

MARINE PROPULSION SYSTEM

CROSS-REFERENCE TO RELATED APPLICATIONS

The present application is a continuation of U.S. patent application Ser. No. 12/993,066 filed Nov. 16, 2010, which claims priority to and is a national stage filing of International Patent Application No. PCT/US2009/044366 filed May 18, 2009, which claims priority to and is a non-provisional of U.S. Provisional Patent Application No. 61/053,817, filed May 16, 2008, the contents of each afore-identified application are expressly incorporated herein by reference.

FIELD OF THE INVENTION

The present invention is in the field of jet propulsion. Specifically, the present invention relates to a marine jet propulsion system and vehicles incorporating such systems. More specifically, the present invention relates to a marine jet propulsion system utilizing the physical phenomena known as the Coanda effect to produce a propulsive force.

BACKGROUND AND SUMMARY OF THE INVENTION

As employed herein, the term "fluid", unless, otherwise explicitly indicated, is intended to encompass matter which exhibits a fluid or flowable characteristic, including gases and liquids with or without particulate solids in suspension, as well as mixtures thereof.

As employed herein, the term "Coanda nozzle" refers to a nozzle based on the Coanda Effect and includes configurations such as those disclosed in U.S. Pat Nos. 2,052,869 and 3,337,121.

The system of the present invention may be used to propel any of a number of vehicles, including surface vessels, submarines, torpedoes, aircraft, and land vehicles, etc.

The Coanda effect is the tendency of a jet of fluid to follow a wall contour when discharged adjacent to a surface, when that surface curves away from the jet discharge axis. As more fully described in U.S. Pat. No. 2,052,869, granted Sep. 1, 1936 to Henri Coanda, the substance of which is hereby incorporated by reference, the Coanda effect is apparent when a stream of fluid emerges from a container, through a slot or other aperture, if one of the lips forming the walls of the slot is extended and recedes continuously from the direction of the axis of the slot. Under such conditions, the fluid clings to the extended lip and tends to increase in velocity, producing a reduced pressure region and causing an intake of large quantities of the surrounding fluid. Furthermore, U.S. Pat. No. 3,337,121, granted Aug. 22, 1967, also to Henri Coanda, the contents thereof is hereby incorporated by reference herein, describes a fluid propulsion system based on the Coanda effect.

One goal of the present invention is to produce a high efficient jet propulsion system using existing components. Furthermore, the system of the present invention can be used in a wide variety of applications from light outboard units to heavy inboard installations.

The present invention includes a marine propulsion system comprising: (1) a fuel-filled tank; (2) an air compressor that generates compressed air; an engine that receives fuel from the tank, wherein the air compressor is powered by the engine; and (3) at least one hot gas generator that receives compressed air from the air compressor, the hot gas generator comprising: (a) a combustion chamber having an inlet and an outlet, the compressed gas injected into the combustion chamber at the inlet, the combustion chamber adapted to produce hot gas; (b) an injection nozzle that receives fuel from the tank, the injection nozzle positioned proximate to the inlet of the combustion chamber, the injection nozzle adapted to spray the fuel into the combustion chamber; and (c) an exhaust nozzle positioned at the outlet of the combustion chamber through which the hot gas produced in the combustion chamber is discharged from the hot gas generator.

In order that the invention may be better illustrated, it will now be described in connection with particular embodiments, reference being made to the accompanying drawings. These embodiments are given solely for the purpose of illustration, and they act in no way to limit the scope of the present invention.

BRIEF DESCRIPTION OF THE DRAWINGS

The invention is explained in greater detail based on drawings that reveal additional ideas of the invention, as to the dependent claims.

DETAILED DESCRIPTION OF THE PREFERRED EMBODIMENT(S)

Figure 1:
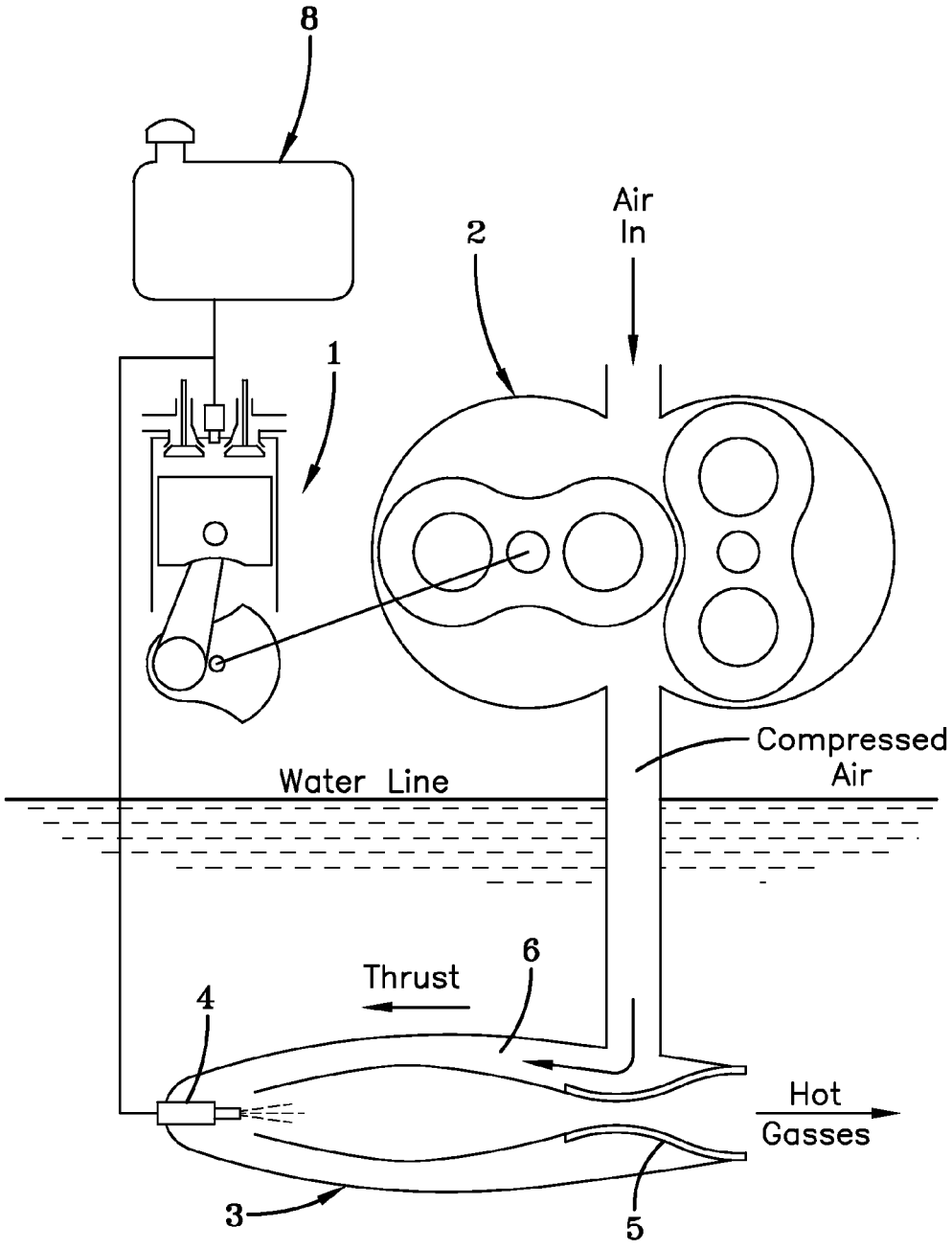
FIG. 1 provides a diagram of a marine propulsion system in accordance with one embodiment of the present invention.

One embodiment of the present invention is shown in FIG. 1. As depicted, the basic system consists of a piston engine 1 driving an air compressor 2 and a hot gas generator 3. The combustion chamber of a gas generator 3 is supplied with fuel by an injection nozzle 4 and the compressed air delivered by the compressor 2. The hot gas generated by the gas generator 3 is exhausted into the water with the help of an exhaust nozzle 5. The thrust is obtained by the hot gas impulse (similar to an aviation jet engine) and by the back pressure of the gas bubble formed in water in the exhaust nozzle's close vicinity. The exhaust nozzle 5 might have a convergent-divergent configuration, but may alternatively possess a different shape more suitable to the use of the advantage of the back pressure. The exhaust nozzle 5 may be designed with or without a constriction or may alternatively be adjustable to accommodate a variety of desired speed/thrust combinations. Prior to being mixed with the fuel, the compressed air is heated by a heat recovery device 6. The recovery device 6 acts like a heat exchanger keeping the gas generator wall temperature low and preheating the compressed air (saving some fuel). The gas generator 3 and the engine 1 are supplied with fuel from a tank 8. However, different types of fuel might be used for the engine and for the gas generator. Accordingly, more than one tank may be necessary. For example, a first tank containing gasoline may be used in conjunction with the engine, while a second tank containing jet fuel may be used in conjunction with the hot gas generator.

The driving engine 1 may be any type of internal combustion engine having one or more reciprocated or rotating pistons and functioning with 2 or 4 strokes, using Diesel, Otto or Atkinson cycles. The engine could alternatively be replaced by any suitable device capable of powering air compressor. The air compressor 2 may operate by positive displacement or dynamic functioning. Alternatively, the air compressor could be replaced by any device capable of providing compressed air to the hot gas generator. For example, a 30-hp Briggs & Straton 2-cylinder small engine driving an Eaton M45 supercharger is expected to develop more than 200 hp in water at a fraction of the price and weight typically seen for a 200 hp big 4-cylinder conventional outboard. It is also expected that other existing engine-compressor combinations may be utilized to deliver 3-5 times more power than the most powerful outboard at this time of this writing. In an ideal case, the water power exceeds the engine power in a ratio equal with the compressor airflow reported to the engine airflow and subsequently, the ratio between the fuel injected in the gas generator and the fuel used by the engine. With the use of custom design components this ratio may exceed 10.

Figure 2:
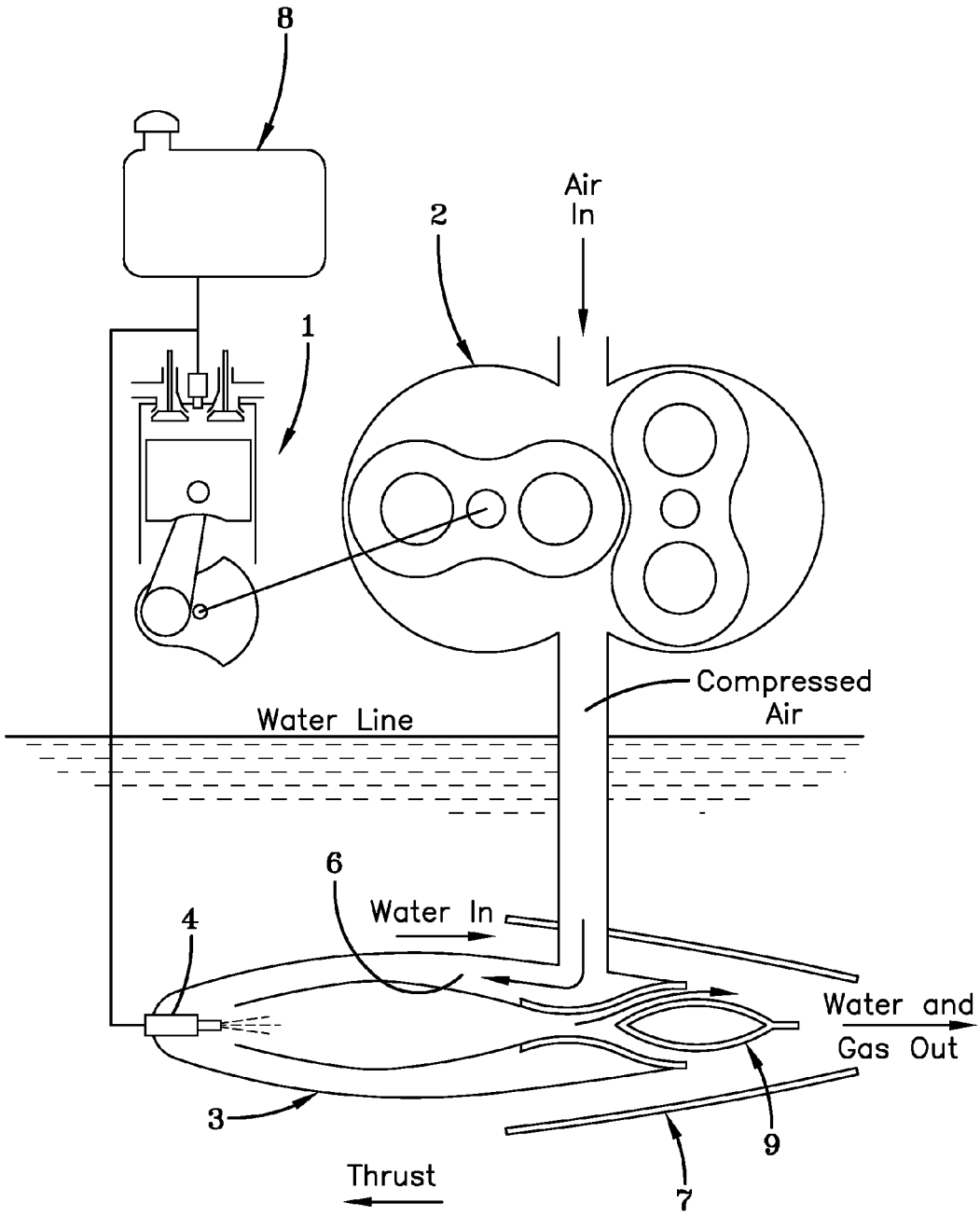
FIG. 2 provides a diagram of a marine propulsion system in accordance with one embodiment of the present invention.

FIG. 2 illustrates a second embodiment of the present invention which generates thrust based on the exhaust gas energy. If exhaust nozzle 5 from FIG. 1 is a direct thrust producer (the gas energy is used to produce impulse and back pressure) the exhaust Coanda nozzle 7 shown in FIG. 2 is using exhaust gas energy to accelerate water. The Coanda nozzle 7 is based on the Coanda Effect, as described in U.S. Pat. No. 3,337,121, which exploits the deviation of a jet fluid into another fluid and may include a deflector 9. Thus, the high velocity gas jet will produce a lower velocity water jet acting similar to an absorption-repulsion pump. Although the water jet velocity is much smaller than the gas velocity, the large water mass flow can produce a thrust bigger than what can be obtained directly with the same gas energy (at the cost of a lower operational speed).

As clearly seen in FIG. 2, the deflector 9 has outwardly curved (i.e., convex) walls. The deflector 9 is positioned directly behind the nozzle and along a central longitudinal axis of the nozzle, such that hot gas discharged from the nozzle follows the contour of the deflector 9 (or the walls of the deflector), which causes an intake/entrainment of the surrounding water into the exhaust gas so as to produce higher thrust.

Figure 3:
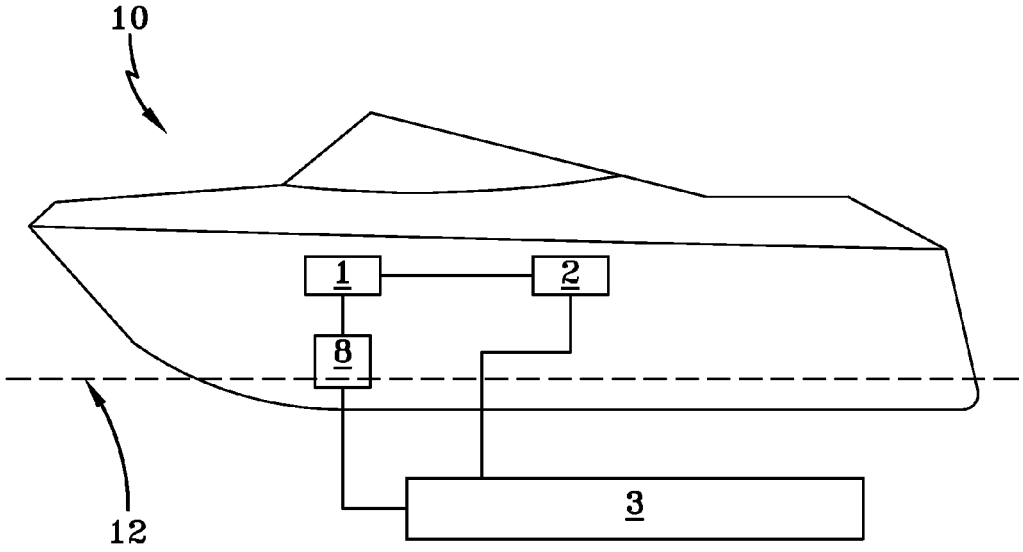
FIG. 3 provides an illustration of a vessel comprising a marine propulsion system in accordance with one embodiment of the present invention.

FIG. 3 provides an illustration of a vessel 10 equipped with a marine propulsion system according to the present invention such that the hot gas generator is positioned below water line 12 as when the vessel is afloat. The hot gas generator could alternatively be positioned so as to be above the water line. The placement of the engine 1, the air compressor 2, and the tank 8 are arbitrary and could each be placed either above or below the water line 12.

The invention being thus described, it will be obvious that the same may be varied in many ways. Such variations are not to be regarded as a departure from the spirit and scope of the invention, and all such modifications as would be within the scope of the following claims.

What is claimed is:

1. A marine propulsion system comprising:

a tank adapted to hold fuel;

an air compressor capable of generating compressed air;

an engine in fluid communication with said tank so as to receive said fuel to operate said engine with, wherein said air compressor is powered by said engine; and at least one hot gas generator in fluid communication with said air compressor so as to receive at least a portion of said compressed air, said hot gas generator comprising:

(a) a combustion chamber having an inlet and an outlet, said compressed air injected into said combustion chamber at said inlet, said combustion chamber adapted to produce hot gas;

(b) at least one injection nozzle in fluid communication with said tank so as to receive said fuel, said injection nozzle positioned proximate to said inlet of said combustion chamber, said injection nozzle adapted to spray said fuel into said combustion chamber; and (c) an exhaust nozzle positioned at said outlet of said combustion chamber through which said hot gas produced in said combustion chamber is discharged from said hot gas generator, wherein a deflector with outwardly curved walls is positioned behind the nozzle and along a central longitudinal axis of the nozzle, and wherein said hot gas is discharged adjacent to the walls of the deflector such that said hot gas follow said walls thereby causing the intake of surrounding water into said hot gas adjacent said walls so as to produce thrust.

2. The marine propulsion system according to claim 1 wherein said exhaust nozzle has a convergent-divergent configuration.

3. The marine propulsion system according to claim 1 wherein said compressed air is heated before entering said combustion chamber.

4. The marine propulsion system of claim 1, wherein the exhaust nozzle is a Coanda nozzle.

5. A vessel comprising the marine propulsion system according to claim 1.

6. A vessel comprising the marine propulsion system according to claim 2.

7. A vessel comprising the marine propulsion system according to claim 3.

8. A vessel comprising the marine propulsion system according to claim 4.

* * * * *